US005158219A

United States Patent [19]

Baumgartner et al.

[11] Patent Number: 5,158,219

[45] Date of Patent: Oct. 27, 1992

[54] WATCH-CASE

[75] Inventors: Alain Baumgartner, Sainte-Croix; Romolo Brancaleoni, Les Hauts-Geneveys, both of Switzerland

[73] Assignee: Bratec Baumgartner & Brancaleoni, Sainte-Croix, Switzerland

[21] Appl. No.: 696,250

[22] Filed: May 6, 1991

[30] Foreign Application Priority Data

Jun. 7, 1990 [CH] Switzerland ..... 1914/90

[51] Int. Cl.[5] ..... A44C 5/00

[52] U.S. Cl. ..... 224/164; 224/170; 224/176; 24/265 WS; 368/282

[58] Field of Search ..... 224/164, 169, 170, 174, 224/176, 177; 368/281, 282; 24/265 WS, 265 B

[56] References Cited

U.S. PATENT DOCUMENTS

| | | | |
|---|---|---|---|
| 2,559,238 | 7/1951 | Wallin . | |
| 3,277,646 | 10/1966 | Howard, Sr. . | |
| 3,403,505 | 10/1968 | Gisiger-Lusa . | |
| 3,492,809 | 2/1970 | Gisiger-Lusa . | |
| 4,757,485 | 7/1988 | Man | 368/281 |
| 4,903,253 | 2/1990 | Nikles et al. | 368/282 |

FOREIGN PATENT DOCUMENTS

| | | | |
|---|---|---|---|
| 709518 | 5/1931 | France | 368/282 |
| 1151234 | 1/1958 | France | 224/164 |
| 1259293 | 3/1961 | France | 24/265 WS |
| 216721 | 9/1941 | Switzerland | 224/164 |
| 304445 | 3/1955 | Switzerland | 368/282 |
| 865498 | 4/1961 | United Kingdom | 368/282 |

*Primary Examiner*—Linda J. Sholl
*Attorney, Agent, or Firm*—Darby & Darby

[57] ABSTRACT

The middle of the watch (1) is provided with two lateral protuberances (2, 3) each having a groove (4, 5) intended to receive the pin (6) of a piece of bracelet (7). On the middle (1) is mounted a ring (8) by means similar to that of a rotary rim. The rotary rim (8) is also provided with two lateral protuberances (9, 10) whose shape is complementary to that of the protuberances (2, 3) of the middle (1) in order to lock, and unlock the extremities of the bracelet.

7 Claims, 2 Drawing Sheets

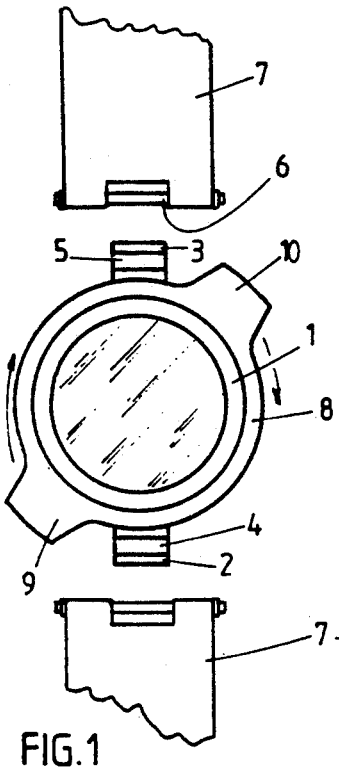
FIG. 1
FIG. 2
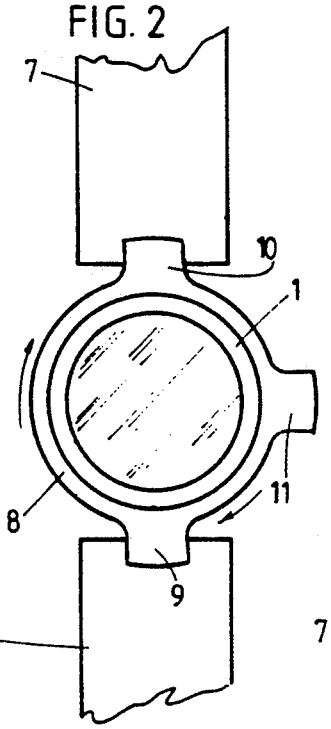
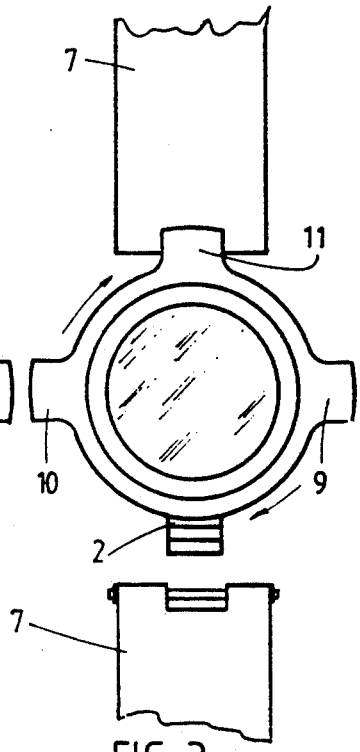
FIG. 3
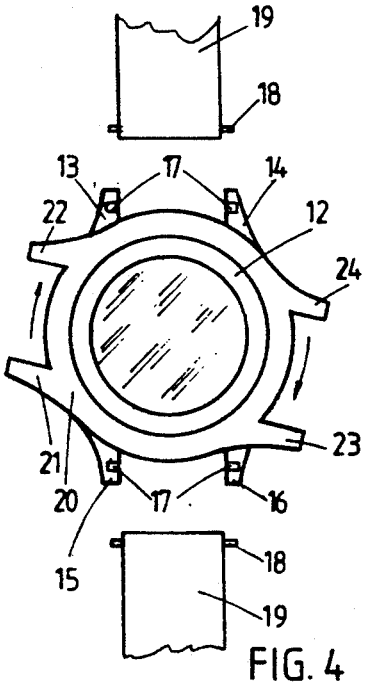
FIG. 4
FIG. 5
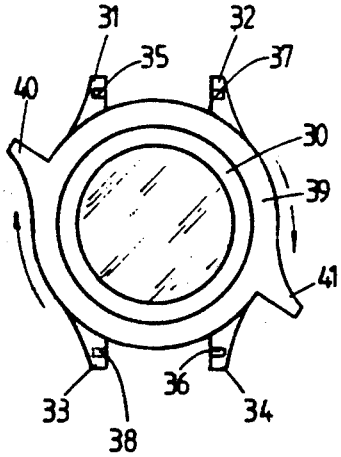
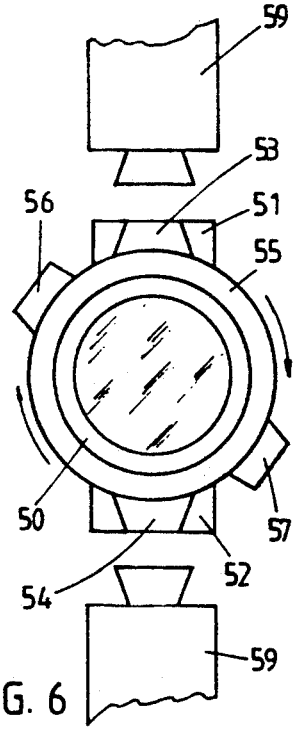
FIG. 6

WATCH-CASE

FIELD OF THE INVENTION

The present invention relates to a watch-case provided with a rotary rim and particularly a watch-case of a wrist-watch.

PRIOR ART

An important element for putting together a wrist-watch is the bracelet which allows to attach the wrist-watch around the wrist and, in the same way, for a medallion-watch, a chain is the important element allowing to have the watch hanging from the neck or for all watches of the brooch type suspended by a flexible strap intended to be hooked to a clothing, the chain or flexible strap being one of the esthetic elements of the watch. The evolution of habits and trends has created new needs particularly as to changing the bracelet or the flexible strap of a brooch-watch or the chain of a medallion-watch in order to adapt the watch either to the circumstances or to the clothing, or to the trend. Except for fancy watches which are often sold with bracelets of various colors associated to a rim or other means allowing a rapid change of bracelet and the rim which has a color matching the bracelet, the watches of a certain quality use always conventional means for fixing the bracelet, that is to say horns or protuberances with a housing for the extremity of the bracelet which is made of leather or metal and therefore changing the bracelet is not an operation which can be carried out instantaneously by the user. Often the user must see the technician for changing the bracelet or the user must use one or several appropriate tools to carry out the same work.

Another element of the bracelet of a watch which is sometimes a problem is the buckle, particularly concerning metal bracelets since, when setting the bracelet to the right length as a function of the circumference of the user's wrist.

It is important to shorten equally both pieces of the bracelet so that the buckle remains always positioned at the right location. Concerning leather bracelets, each time one puts on or takes off the watch, one has to unhook the extremity of one piece and make it slide through the loop, and this causes a certain wear of such extremity, this being a drawback particularly when the bracelet is of high quality and costly.

SUMMARY OF THE INVENTION

The present invention proposes a remedy to the above mentioned inconveniences concerning the rapid change of a bracelet or any other strap of a watch and/or the elimination of problems caused by conventional buckles of a wrist-watch.

The watch-case provided with a rotary rim according to the invention is characterized in that the rotary rim and the middle include complementary means to provide for the holding and locking of at least one of the extremities of a strap, such as a bracelet and in that the rim and the middle are arranged to allow the instantaneous unlocking and locking of the extremity of said strap.

The advantage of the watch-case according to the invention, which concerns essentially a case of a wrist-watch but also a brooch-watch suspended by means of a flexible strap or a medallion-watch is that the holding of one of the extremities of the flexible strap and the locking with the case are provided by means complementary of the rotary rim and of the middle designed to allow the instantaneous unlocking and locking. Thus, to achieve such result, the assembly of the rotary rim and the middle is performed so that the rim may turn by at least a few degrees about an axis perpendicular to the plane of the watch dial. Such assembly thus allows the locking and unlocking of the strap extremity by a simple rotation of the rim by a few degrees, such rotation allowing to separate or bring together the complementary means in order to unlock respectively lock the strap extremity of the bracelet.

Various forms of execution are possible which all remain in the gist of the invention, that is to say the holding and locking of the extremity of a flexible strap by cooperation of complementary means which are, on the one hand on the middle and, on the other hand on the rim. Their arrangement as well as the assembly of these two pieces are designed in order to make possible instantaneous locking and unlocking.

BRIEF DESCRIPTION OF THE DRAWINGS

Different examples of embodiments will now be described by means of annexed drawings.

FIG. 1 is a planar diagrammatic view of a watch-case and extremities of a watch strap in an unlocked position.

FIG. 2 is a planar diagrammatic view of another embodiment of a watch-case according to the invention with the strap in the locked position.

FIG. 3 is a planar diagrammatic view of the same embodiment a in FIG. 2, but with one strap unlocked.

FIG. 4 is a view similar to the preceding views of an embodiment of a watch-case according to the invention with two pairs of horns within the unlocked position.

FIG. 5 is a view of an alternative mode of execution.

FIGS. 5 and 6 are planar diagrammatic views of other embodiments of a watch-case according to the invention alternative mode of execution.

DESCRIPTION OF THE PREFERRED EMBODIMENTS

Figure 7:
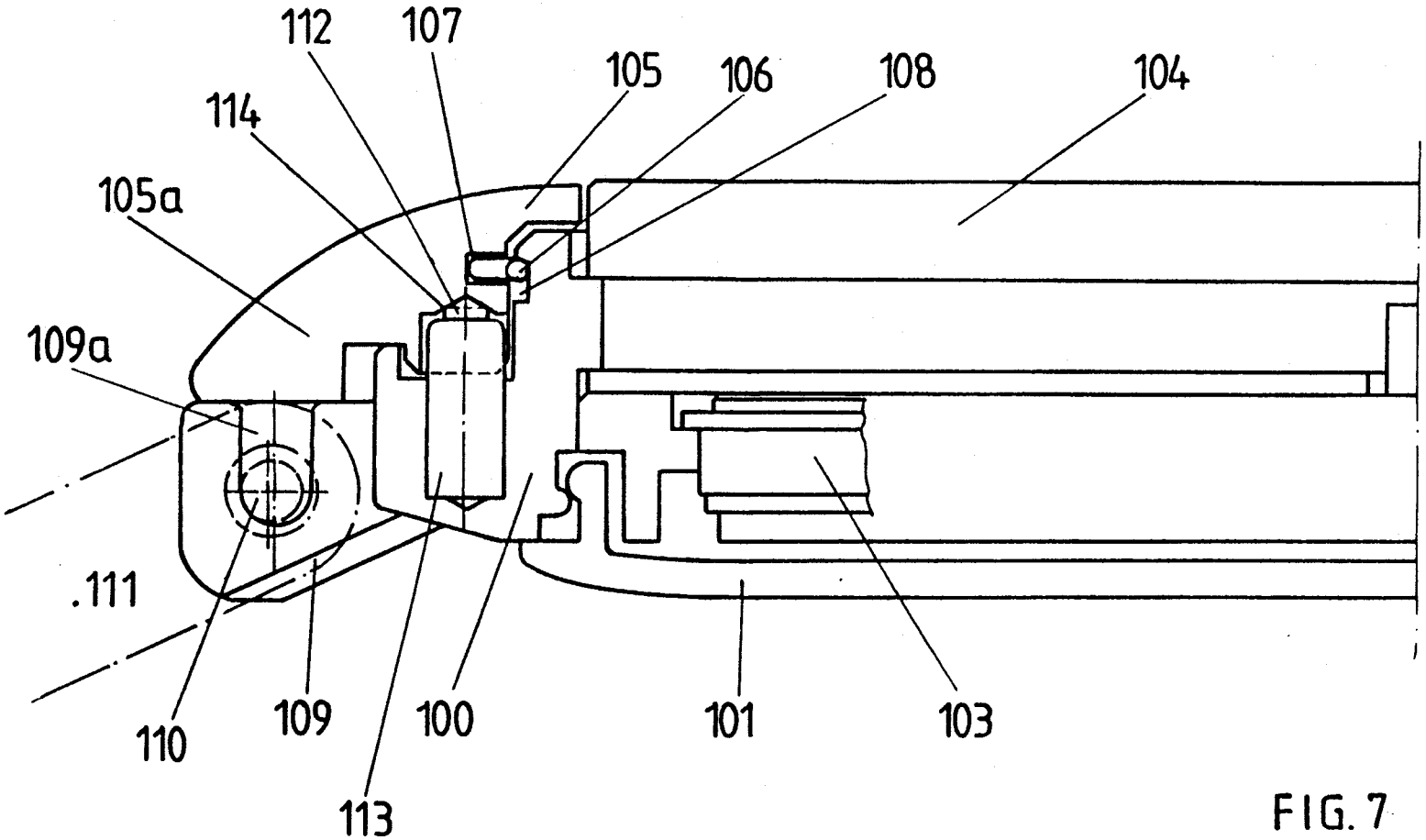

In all executions which will be described hereafter, the rim is rotatingly mounted on the middle in a known manner. An example of such assembly will be described by using FIG. 7.

FIG. 1 represents schematically a watch middle 1 provided with two side protuberances 2 and 3 each having a groove 4, 5 receiving the pin 6 of a bracelet piece 7. Under middle 1 is mounted a turning rim 8 by means which will be described later. The rim 8 is also provided with two side protuberances 9, 10 whose shape is complementary of that of the two protuberances 2 and 3 of the middle.

In order to hook the bracelet piece 7 to the watch, the rim 8 is rotated by a few degrees so as to clear the two protuberances and particularly the two grooves 4 and 5, the pins 6 are engaged into the grooves, for both bracelet pieces, and the rim 8 is rotated in the opposite direction in order to superimpose the protuberances 9 and 10 on the protuberances 4 and 5, and as a result the extremities of the bracelet are held, on the one hand by the grooves 2 and 3 and, on the other hand locked by the protuberances 9 and 10.

By this simple means, that is to say by turning the rim by a few degrees, it is possible to rapidly change a bracelet, whether it be a leather strap or a metal bracelet, for as long as its extremities are provided with a pin 6. In order to avoid an inadvertent unlocking, there is provided a means between the rim 8 and the middle preventing the rim 8 from rotating inadvertently, that means being described later by using FIG. 7. When the unlocking of the bracelet extremities is desired, it is necessary to apply to the rim a rotation moment which is relatively high at least with respect to the rotation moment which may inadvertently or accidentally occur.

In order to avoid that the pins 6 of the bracelet disengage too easily when the rim 8 is an unlocking position, said grooves may be designed so that their walls are oblique, in other words they come into the thickness of the protuberances towards their free extremities.

FIGS. 2 and 3 represent the same watch-case and the same reference numerals are used to indicate the same elements. In this case, the rim is provided with an intermediary protuberance which may easily correspond to the protuberance found in certain cases and protecting the crown-wheel of the winder or time-setting pin. Such protuberance 11 is useful when avoiding the utilization of a conventional buckle, so that to take off a wristwatch, it is only necessary to rotate the rim 8 by 90° so that the protuberance 11 faces the protuberance 3 or optionally 2 so that one of the two protuberances is locked and only one of the two protuberances is disengaged, in the present case the protuberance carrying the reference numeral 2, in order to unhook the bracelet.

In this way, it is possible to take off or put on a wristwatch around the wrist without using a buckle.

It is evident that one could also imagine a rim 8 provided with a single protuberance allowing to unlock only one extremity of the bracelet so the location of rim 8 corresponds to the opening or closing of a wristwatch buckle.

FIG. 4 represents a watch-case 12 provided with two pairs of conventional horns 13, 14, 15 and 16, each having a notch 17 provided to receive the pin 18 of a watch bracelet 19. A rim 20 is mounted in the same way as previously on the middle and it is also provided with four projections 21, 22, 23 and 24 whose shape is complementary to that of the horns 13 through 16 of the middle. After insertion of the pin 18 in the small holes 17 of the four horns, the rim 20 is rotated so that the projections 21, 22, 23 and 24 are superimposed with the horns 13, 14, 15 and 16, thus obtaining the locking of the bracelet extremities. Here as well, a device prevents the inadvertent rotation of rim 20 in order to avoid an accidental unlocking.

It is also possible to have a rim provided only with two projections either 21, 22, or 23 and 24, so that the rim acts as a buckle and not as an element allowing to change rapidly the bracelet.

FIG. 5 represents another alternative form of execution similar to that described in FIG. 4, that is to say that the watch-case 30 is also provided with two pairs of horns 31, 32, 33 and 34, but this time the diametrally opposed horns 31 and 34 are provided with a hollow 35, 36 whereas the horns 32, 33 are provided with a hole, blind or not, 37, 38. A rim 39 is mounted on the middle as previously disclosed and it is provided only with two projections 40, 41 having a shape complementary to the horns 31 and 34 provided with notches 35, 36. In this case, in order to change the bracelet, it is necessary to slide one of the extremities of each pin in the hole 38 and 37 and lay the other extremity in the notches 35 and 36 which will be locked by turning the rim 39 so that the projections 40 and 41 are superimposed to the horns 31 and 34.

FIG. 6 represents a last alternative form of execution of a watch-case 50 provided with two lateral protuberances 51 and 52 provided with a hollow shaped, for example like a dovetail 53, 54 intended to receive the extremity of a bracelet piece 59 of corresponding shape, a rotating rim 55 being provided with two projections 56, 57 superimposed to the protuberances 51, 52 to lock as previously the extremity of the bracelet. From the previously disclosed examples, it is possible to imagine a variety of alternative embodiments with the same gist of the invention.

FIG. 7 represents a cross-sectional view **12*h*–12*h*** of an embodiment of the invention, such view is essentially presented to show a possible execution of the assembly of the rotary rim to the middle with bezel, as well as a means impeding the rotary rim from rotating inadvertently.

The watch-case is comprised of a middle with bezel 100 closed by a button 101 which may be screwed or encased etc., housing a work 103 and closed at the top by a glass 104. A turning rim 105 is mounted on the middle with bezel 100, the assembly being ensured by a spring 106 forming a polygonal line and housed in two grooves 107 and 108 facing each other and provided on the rim 105 and the middle with bezel 100.

The middle with bezel 100 is provided with a protuberance 109 having a hollow **109*a* (such as for example that of pin 6) intended to house the pin 110 of a bracelet piece 111 (similar to that of FIG. 1). The rim 105 is also provided with a complementary protuberance 105*a* allowing to lock the pin 110 in the hollow 109*a***.

As a matter of fact, such execution of the rotary rim may be applied to any execution of the preceding Figures (horns, protuberances, dovetail...).

In order to prevent the inadvertent unlocking of the extremity of a strap, it is possible to provide one or a plurality of balls or studs with spherical heads 112 each of them being housed in a socket 113 crimped in the middle with bezel and comprising an elastic means (for example a spring) to push the ball or the stud in a depression 114 of the rim. Thus, when the depression 114 is facing the wall or the stud 112, the rim 105 cannot be rotated inadvertently. A higher rotation moment is necessary in order to close the rim 105 and make the ball or stud 112 come out of the depression 114.

As a matter of fact, other locking means for the rotary rim may be used without departing from the gist of the invention.

Although mainly wrist-watches have been herein disclosed, it is evident that the invention may be used for brooch-watches suspended by means of a flexible strap and, in this case, instead of having two protuberances or two pairs of horns etc... just one is enough. The aim of the invention is to be able to change the strap so that, for example, it matches the clothing or circumstances. In the same line, instead of a brooch-watch, the invention could be applied in the same way to a medallion-watch.

As a function of the watch putting, various forms of execution are possible, for example the rotary rim may be provided with two notches instead of two protuberances, which have to be positioned facing the housing provided in the middle by the extremities of the bracelet in order to obtain the unlocking of the bracelet.

We claim:

1. A watch case comprising a watch middle housing, a rim member, and spring means arranged between said housing and said rim member for rotatably retaining said rim member on said housing, said housing and said rim member each having complementary means for cooperating to receive at least one extremity of a strap and to substantially instantaneously lock said one extremity of the strap to said case upon rotation of said rim member to a predefined position relative to said housing, said middle housing in said rim member having facing peripheral grooves, said spring means being located in said facing peripheral grooves for relatively rotatably retaining and middle housing and said rim member.

2. A watch-case according to claim 1 wherein said middle housing and said rim member each have additional complementary means for receiving another extremity of the strap.

3. A watch-case according to claim 1 wherein said one extremity of the strap includes a pin, and said complementary means comprise at least one pair of horns provided on one of said middle housing and said rim member, with each horn having a recess for receiving the pin, and at least one pair of projections provided on the other of said middle housing and said rim member and cooperating with said horns to lock the pin upon rotation of said rim member in one of said respective opposite directions.

4. A watch-case according to claim 2 wherein each of extremities of the strap includes a pin and said complementary means and additional complementary means comprise a pair of horns provided on one of said middle housing and said rim member, with one of said horns having a notch and the other of said horns having a hole for lodging the pin, and a projection provided on the other of said middle and said rim and superimposable over the one of said horns, the one of said horns of said complementary means and the one of said horns of said additional complementary means being arranged diametrically opposite to each other.

5. A watch-case according to claim 1 further comprising means for impeding inadvertent rotation of said rim member relative to said middle housing to prevent inadvertent unlocking of the at least one of extremities of the strap.

6. A watch-case according to claim 5 wherein said impeding means comprises spring-biased means mounted in one of said middle housing and said rim member and a depression for receiving said spring-biased means formed in the other of said middle housing and said rim member.

7. A watch-case comprising a watch middle and a rim supported by said middle and rotatable relative thereto, said middle and said rim each having complementary means for receiving at least one extremity of a strap and cooperating to substantially instantaneously lock and unlock said one extremity of the strap upon rotation of said rim relative to said middle in respective opposite directions, said complementary means comprising at least one lateral protuberance extending from one of said middle and said rim and having means for receiving said one extremity of the strap, and one complementary element extending laterally from the other of said middle and said rim and operable with said lateral protuberance to lock said one extremity of the strap upon rotation of said rim relative to said middle in one of said respective opposite directions; said complementary means further comprising another lateral protuberance extending from the one of said middle and said rim, arranged diametrically opposite to said at least one lateral protuberance, and having means for receiving another extremity of the strap, another complementary element extending laterally from the other of said middle and said rim, arranged diametrically opposite to said one complementary element, and superimposable over said another lateral protuberance; and an intermediate lateral complementary element extending laterally from said other of said middle of said rim and located between said one and another complementary elements for superpositioning over one of said one and another lateral protuberance upon unlocking relative rotation of said rim to lock a respective one of the extremities of the strap to thereby provide for unlocking of only one of the extremities of the strap.

* * * * *